United States Patent [19]

Kenner

[11] 4,354,643

[45] Oct. 19, 1982

[54] BATHROOM TISSUE HOLDER

[76] Inventor: Mary B. Kenner, 1 Mile Course, Kings Mill, Williamsburg, Va. 23185

[21] Appl. No.: 208,184

[22] Filed: Nov. 18, 1980

[51] Int. Cl.[3] ..... B65H 19/00

[52] U.S. Cl. ..... 242/55.2

[58] Field of Search ..... 242/55.2, 55.3, 55.53–55.55, 242/68, 76

[56] References Cited

U.S. PATENT DOCUMENTS

| | | | |
|---|---|---|---|
| 2,324,796 | 7/1943 | Neptune | 242/55.2 |
| 2,626,109 | 1/1953 | Hart | 242/55.2 |
| 3,450,363 | 6/1969 | Williams | 242/55.53 |
| 4,234,134 | 11/1980 | Rhine | 242/55.2 |

*Primary Examiner*—Leonard D. Christian

*Attorney, Agent, or Firm*—Harvey B. Jacobson

[57] ABSTRACT

A holder for retaining the free or loose end of a roll of bathroom tissue or toilet paper in accessible position spaced away from the periphery of the bathroom tissue or toilet paper roll. The holder is generally of U-shaped configuration with a pair of generally parallel legs terminating in hook-shaped components for engagement over the spindle of a conventional toilet paper holder and a plurality of spaced rod-like or dowel structures interconnecting the outer end portions of the legs for receiving the free end of the bathroom tissue or toilet paper therethrough for retaining the free end of the tissue or paper in accessible position. The holder also includes a pair of supporting members or spacers which extend inwardly toward a wall surface to space the outer ends of the legs away from the wall surface so that the free end of the tissue or paper will generally depend tangentially from the roll of bathroom tissue or toilet paper thereby eliminating the problem of grasping the free end of a roll of bathroom tissue or toilet paper which occurs when the free end of the tissue or paper is positioned tightly against the remainder of the toilet paper or roll.

6 Claims, 4 Drawing Figures

BATHROOM TISSUE HOLDER

BACKGROUND OF THE INVENTION

1. Field of the Invention

The present invention generally relates to a bathroom tissue or toilet paper holder and more specifically to a structure which can be attached to an existing toilet paper holder without modification and will effectively retain the free end of the paper in depending, tangential relation to the toilet paper roll thereby maintaining the free end of the paper in a position for ready access by a user thereby eliminating problems encountered when trying to grasp the end of the toilet paper when it is oriented in close surface-to-surface engagement with the remainder of the toilet paper roll.

2. Description of the Prior Art

Toilet paper or bathroom tissue is provided in the form of a roll spirally wound on a cardboard core. Various types of holders have been provided to rotatably support a roll of toilet paper on or partially recessed in a wall section adjacent a commode in a bathroom for convenience of use. The free end of a toilet paper roll frequently becomes difficult to grasp when it is disposed in surface-to-surface contact with the periphery of the remainder of the paper roll. This is especially difficult to individuals whose fingers have reduced dexterity capabilities. In recognition of this problem, the following U.S. patents relate to structures which hold the free end of the toilet paper in spaced relation to the toilet paper roll:

U.S. Pat. Nos. 2,331,791—Oct. 12, 1943—Noel; 2,737,353—Mar. 6, 1956—Banks; 2,832,549—Apr. 29, 1958—Youngberg; 3,972,458—Aug. 3, 1976—Hamada; 4,191,317—Mar. 4, 1980—Harkins.

Additionally, U.S. Pat. No. 429,029, issued May 27, 1890, discloses a holder and cutter for paper being unwound from a roll.

All of the structures disclosed in the above-mentioned patents are somewhat complicated, with some of them requiring special modification of conventional structures, difficult threading of the end of the paper roll through the mechanism and a cutting edge against which the paper can be pulled to delineate a line of severance for the portion of the paper to be removed.

SUMMARY OF THE INVENTION

An object of the present invention is to provide a bathroom tissue holder which is capable of quick and easy association with a conventional existing bathroom tissue or toilet paper holder without modification thereof which effectively retains the free end of the paper in depending, tangential relationship to the toilet paper roll so that the free end of the paper can be easily grasped and the desired quantity of paper unrolled from the paper roll and easily torn from the remaining paper on the paper roll in a conventional manner, thus enabling continued use of the paper by following usual procedures, except that the free end of the paper is always readily accessible rather than being difficult to grasp which occurs when the free end of the paper is disposed in surface-to-surface contacting relationship with the periphery of the remaining paper on the toilet paper roll.

Another object of the invention is to provide a holder which is of U-shaped construction and includes a pair of generally parallel legs having hook-like structures at the inner ends thereof for quick and easy hooking engagement with the spindle which normally rotatably supports the toilet paper roll with the legs being positionable between the ends of the toilet paper roll and the side members of the conventional toilet paper holder, thus enabling the device to be quickly and easily mounted in position with respect to the toilet paper roll and its conventional holder and easily removed when desired.

A further object of the invention is to provide a holder in accordance with the preceding objects in which the legs are spaced away from an adjacent supporting wall by inwardly extending support members or spacers connected with the legs adjacent their outer ends and the outer ends of the legs are interconnected by a plurality of generally parallel spaced paper engaging members or dowels which are positioned below the periphery of the roll of paper for receiving the free end of the paper therethrough for retaining the free end of the paper in spaced and generally tangential relation to the periphery of the roll of paper with the free end of the paper depending from the roll.

Still another important object of the invention is to provide a holder for the free end of a roll of toilet paper which is simple in construction, easy to install, inexpensive to manufacture, easy and effective to use and well adapted for the purposes of securing the free end of a paper roll in accessible position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
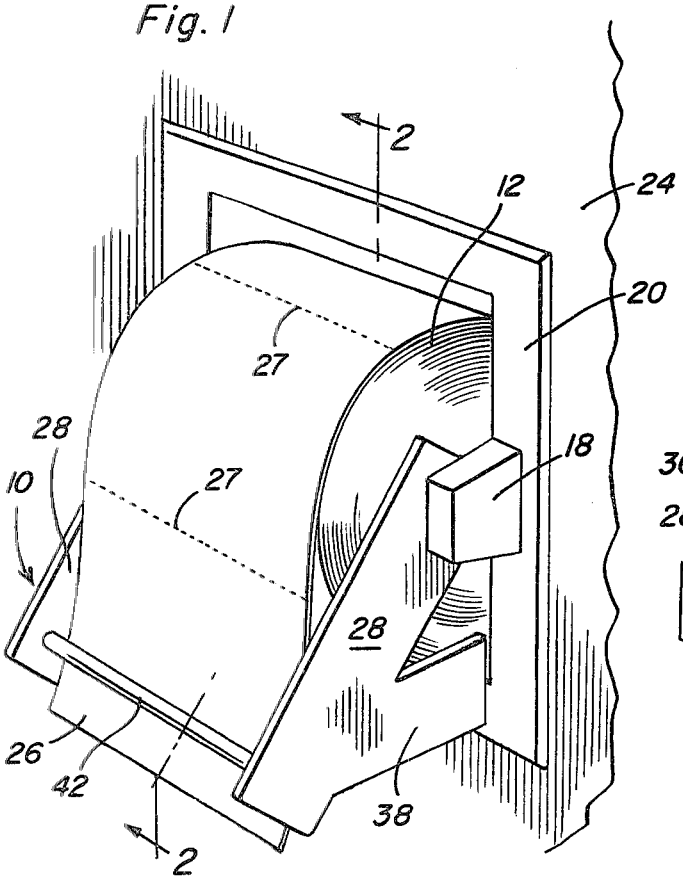
FIG. 1 is a perspective view of the holder of the present invention associated with a conventional, partially recessed bathroom fixture of conventional construction and a roll of toilet paper.
Figure 3:
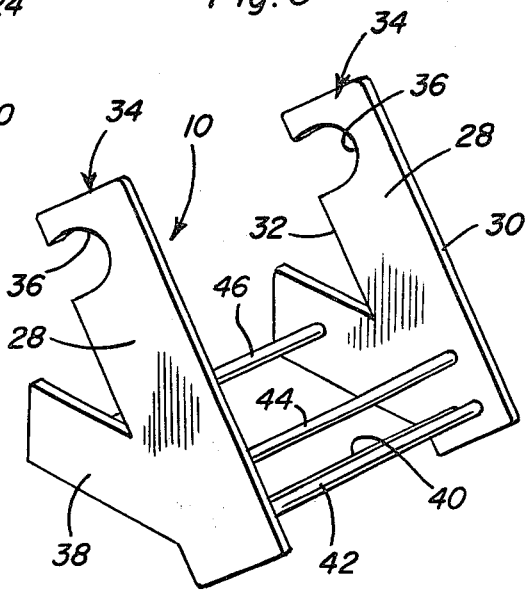
FIG. 3 is a perspective view of one embodiment of the holder for the free end of the paper on a toilet paper roll.
Figure 2:
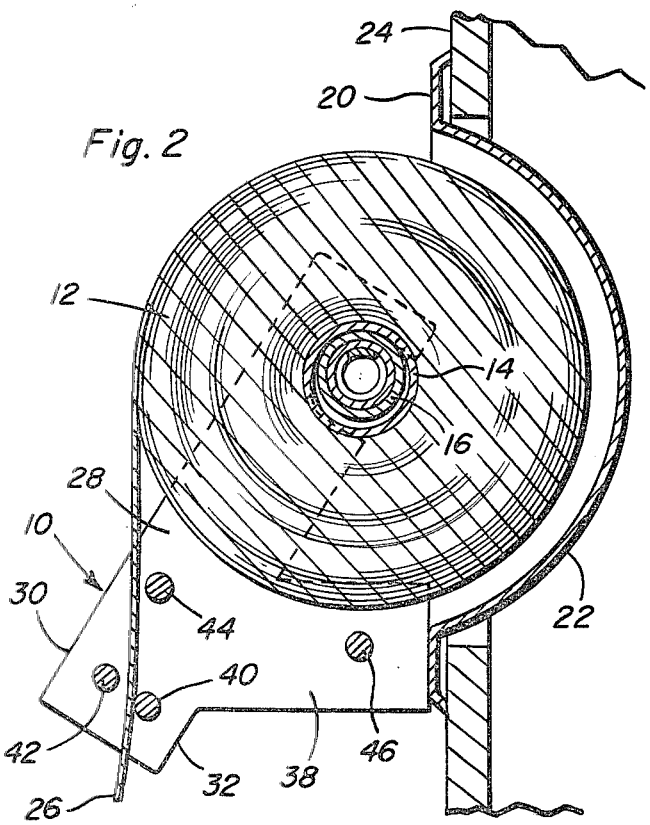
FIG. 2 is a vertical sectional view taken substantially upon a plane passing along section line 2—2 of FIG. 1 illustrating the specific relationship of the holder of the present invention to the conventional paper roll and holder.

Referring now specifically to FIGS. 1–3 of the drawings, the embodiment of the holder of the present invention illustrated therein is generally designated by reference numeral 10 with FIGS. 1 and 2 illustrating the holder in use in which it is associated with a conventional roll of toilet paper or bathroom tissue 12 which is mounted on a conventional cardboard core 14 of cylindrical configuration. The paper roll 12 is supported by a spindle 16 extending through the core and being supported by the ends thereof received in inwardly facing sockets or recesses in a pair of outwardly projecting side members 18 integral with or rigid with a partially recessed fixture 20 which usually includes a curved or angulated inner wall 22 recessed, at least partially, within a wall 24 in a conventional and well-known manner. The specific construction of the supporting holder for the toilet paper roll 12 is conventional and may be varied depending upon various conventional structures employed for this purpose and the holder 10 of the present invention may be utilized with various types of partially recessed or surface mounted toilet paper holders. Conventionally, the spindle 16 is in the form of telescopic members which are spring biased outwardly so that the spindle along with the paper roll thereon may be easily inserted into the sockets or recesses in the side members 18 or the core and spindle may be easily removed therefrom when all the paper has been removed. When using the paper from the paper roll 12, the free end 26 thereof is grasped and pulled until a desired quantity is obtained after which it is torn off along one of the scored lines of weakening 27 provided in the paper. Frequently, the free end 26 of the paper is difficult to grasp since it has a surface attraction to the remainder of the roll and becomes closely associated in surface-to-surface relationship thereto. This is especially a problem to those persons having less than full dexterity in their fingers and even presents a problem to persons with full dexterity in their fingers since the free edge of the paper is hard to discern when it is in intimate surface-to-surface contact with the periphery of the paper roll.

The holder 10 of the present invention includes a pair of generally parallel legs 28 which are relatively thin, strip-like members having parallel top and bottom edges 30 and 32 with the inner end of each leg including a hook-like end portion 34 defined by an upwardly extending notch or recess 36 formed in the bottom edge 32 adjacent the inner end thereof. The notches or recesses 36 have a generally semi-circular inner edge which is adapted to conform to and engage the upper peripheral portion of the cylindrical spindle 16 so that the inner free ends of the legs 28 may be easily inserted between the ends of the paper roll 12 and the side members 18 and the notches 36 brought down over the end portions of the spindle thereby detachably connecting the legs 28 to the spindle. Adjacent the outer ends of the legs 28, a pair of inwardly extending supporting members or spacers 38 are provided and these components extend inwardly toward the wall 24 and engage the wall 24 or the frame of the fixture 20 in order to support the legs 28 in an outwardly inclined relationship to the wall 24. In effect, the legs 28 extend radially of the toilet paper roll 12 in a downwardly and outwardly inclined relation to a vertical plane passing through the longitudinal axis of the spindle 16. Also, the supporting members 38 are of the same construction as the legs 28 which may be in the form of relatively thin plastic material having any desired color which coordinates with the colors in the bathroom, if desired.

The ends of the legs 28 beyond the periphery of the toilet paper roll 12 are interconnected by a plurality of paper engaging members 40, 42 and 44 which are in the form of rod-like structures or dowels. These components may also be constructed of plastic, or the like. The paper engaging members 40 and 42 are spaced closely in relation to each other in opposed, closely spaced relation to a radius line extending from the center of the spindle and between the members 40 and 42 as observed in FIG. 2 so that the free end 26 of the paper will depend therethrough in generally tangential relation to the paper roll 12. Thus, when using the device, the free end 26 of the paper is grasped below the members 40 and 42 and pulled outwardly or downwardly to a desired length after which the paper is torn off below the members 40 and 42, thus leaving the free end of the paper accessible for subsequent use. The paper engaging member 44 is disposed generally vertically above the member 40 and inwardly of the portion of the paper web extending between the periphery of the roll of paper and the members 40 and 42. Thus, the member 44 will keep the free end of the paper 26 spaced from the paper roll 12 even if the paper is unintentionally torn off at a point too close to the members 40 and 42 or if the paper roll for some reason is rotated slightly in a manner to wind the paper onto the roll. Inasmuch as this structure is readily observable, it is quite easy to initially place the free end of the paper downwardly between the members 40 and 42 and the members 40 and 42 may be utilized as a guide to facilitate grasping of the free end of the paper by those having less than full dexterity in their fingers and even by those having less than full eyesight capabilities. This form of the invention may be constructed of plastic material throughout or the members 40, 42 and 44 may be in the form of wood dowels, or the like. Also, the inner end portions of the support members or spacers 38 are interconnected and braced by a rod-like member 46 similar to the members 40, 42 and 44. The rod-like members form a supporting handle structure to enable easy manipulation of the holder when it is being assembled onto the existing bathroom fixture spindle or removed therefrom.

Figure 4:
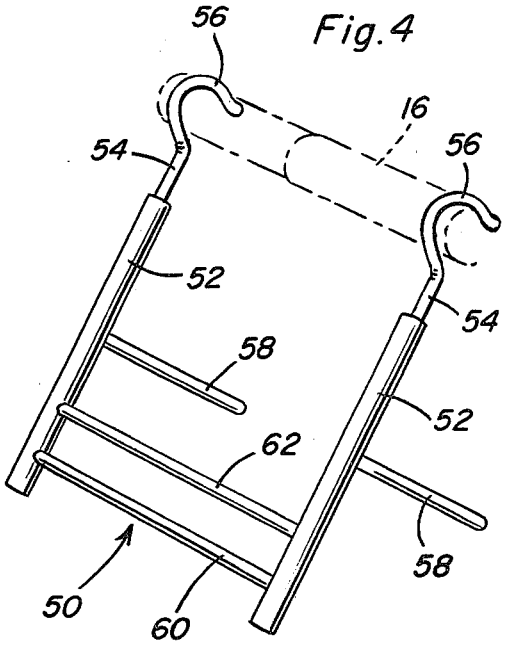
FIG. 4 is a perspective view of another embodiment of the present invention.

FIG. 4 illustrates another embodiment of the invention generally designated by the numeral 50 which includes a pair of side legs 52 in the form of wood dowels each having a metal hook 54 inserted into one end thereof with the pair of hooks 54 including downwardly opening generally U-shaped hook-like end portions 56 to engage the spindle 16. The legs 52 are provided with supporting members or spacers 58 extending downwardly and inwardly therefrom to engage a supporting wall structure and a plurality of parallel transversely extending paper engaging members 60 and 62 interconnect the outer ends of the legs 52 in a manner similar to that illustrated in FIGS. 1–3 for receiving the free end of the toilet paper therethrough. All of the components in this construction are in the form of wood dowels, except for the metal hook members 54, thereby providing a very inexpensive construction. The length and angular position of the supporting members or spacers may be varied depending upon the installational requirements to properly position the members 60 and 62 and a third transverse member, similar to member 44, may be used if desired.

Both embodiments of the invention are readily mounted on or removed from a conventinal bathroom fixture spindle with the hook-like end portions being readily insertable between the end of the paper roll and the supporting structure for the spindle. The free end of the paper is retained in depending tangential relation to the paper roll in a manner readily accessible to persons desiring to grasp and use the toilet tissue in a conventional manner with the device being especially helpful to individuals having physical handicaps such as less than full dexterity in their fingers.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A holder for the free end of a paper web wound into a roll comprising a pair of generally parallel, spaced paper engaging members adapted to receive the free end of the paper web disposed generally in depending tangential relation to the roll to retain the free end of the paper web spaced from the roll and thus accessible for grasping by a person desiring to unwind the paper web from the paper roll and means supporting said paper engaging members to retain them generally in parallel relation to the longitudinal axis of the paper roll, said means supporting the paper engaging members including a pair of generally parallel, laterally spaced legs rigidly affixed to the ends of the paper engaging members and oriented in straddling relation to the paper roll for supporting engagement with the supporting structure for the paper roll, said legs extending downwardly and outwardly from the rotational axis of the paper roll, and support members fixedly secured to the outer end portions of the legs and extending inwardly to space the outer end portions of the legs and the paper engaging members away from a supporting surface for the paper roll.

2. The structure as defined in claim 1 wherein said paper roll is toilet paper mounted on a spindle detachably supported from side supporting members supportingly associated with a wall structure adjacent a commode, said legs having hook-like end portions on their inner ends for hooking engagement over the spindle between the ends of the paper roll and the supporting side members.

3. The structure as defined in claim 2 wherein said legs are in the form of relatively thin strip-like members with the supporting members being of the same material to facilitate insertion of the hook-like end portions into the relatively narrow space between the ends of the paper roll and the side supporting members.

4. The structure as defined in claim 2 wherein said legs and supporting members fixed thereto are in the form of wood dowels, said hook-like end portions being in the form of metal screws inserted into the ends of the wood dowels for engagement with a supporting wall surface.

5. The structure as defined in claim 2 wherein said plurality of paper engaging members includes a pair of rod-like structures disposed adjacent to but on opposite sides of a radius line extending from the rotational axis of the paper roll for receiving the free end of the paper web therethrough.

6. The structure as defined in claim 5 together with a third paper engaging member interconnecting the legs above the pair of paper engaging members to retain the free end of the web spaced from the paper roll in the event the paper web is torn off too close to the paper engaging members.

* * * * *